US009862022B2

(12) United States Patent
Tsutsumi et al.

(10) Patent No.: US 9,862,022 B2
(45) Date of Patent: Jan. 9, 2018

(54) CASTING METHOD USING LOST FOAM

(71) Applicant: Kobe Steel, Ltd., Hyogo (JP)

(72) Inventors: Kazuyuki Tsutsumi, Kobe (JP); Yusaku Takagawa, Kobe (JP)

(73) Assignee: Kobe Steel, Ltd, Hyogo (JP)

( * ) Notice: Subject to any disclaimer, the term of this patent is extended or adjusted under 35 U.S.C. 154(b) by 0 days.

(21) Appl. No.: 15/502,038

(22) PCT Filed: Aug. 5, 2015

(86) PCT No.: PCT/JP2015/072202
§ 371 (c)(1),
(2) Date: Feb. 6, 2017

(87) PCT Pub. No.: WO2016/027672
PCT Pub. Date: Feb. 25, 2016

(65) Prior Publication Data

US 2017/0239711 A1 Aug. 24, 2017

(30) Foreign Application Priority Data

Aug. 18, 2014 (JP) ..... 2014-165863

(51) Int. Cl.
*B22C 9/04* (2006.01)
*B22C 3/00* (2006.01)
(Continued)

(52) U.S. Cl.
CPC ..... *B22C 9/046* (2013.01); *B22C 3/00* (2013.01); *B22C 7/023* (2013.01); *B22C 9/24* (2013.01)

(58) Field of Classification Search
CPC ..... B22C 3/00; B22C 7/023; B22C 9/046
(Continued)

(56) References Cited

U.S. PATENT DOCUMENTS 5,203,398 A * 4/1993 Easwaran ..... B22C 9/046 164/34
2007/0272387 A1* 11/2007 Hirukawa ..... B22D 27/20 164/65
2012/0273151 A1 11/2012 Hirai et al.

FOREIGN PATENT DOCUMENTS

JP S63-183744 A 7/1988
JP H01-266941 A 10/1989
(Continued)

OTHER PUBLICATIONS

International Search Report issued in PCT/JP2015/072202; dated Oct. 27, 2015.
(Continued)

*Primary Examiner* — Kevin E Yoon
(74) *Attorney, Agent, or Firm* — Studebaker & Brackett PC

(57) ABSTRACT

Provided is a casting method using lost foam capable of forming a small highly-finished hole with a diameter of 18 mm or less and a length of 50 mm or more by casting. A casting method using lost foam of the present embodiment includes the steps of embedding, in foundry sand, a casting pattern formed by applying a mold wash with a thickness of 1 mm or more to a surface of the foam pattern, the foam pattern having a hole with a diameter of D (mm); replacing the foam pattern with molten metal by pouring the molten metal into the casting pattern and losing the foam pattern; and forming a casting having a small hole with a diameter of 18 mm or less and a length of 50 mm or more by cooling the molten metal, and the method satisfies the following formulas (0) and (1):

$2<D\leq 19.7$ Formula (0)

$\sigma c\geq -0.36+140/D^2$ Formula (1)

(Continued)

where σc (MPa) is transverse rupture strength (bending strength) of the mold wash that is heated to decompose resin constituting the mold wash and then returned to room temperature.

1 Claim, 17 Drawing Sheets

(51) Int. Cl.
*B22C 7/02* (2006.01)
*B22C 9/24* (2006.01)

(58) Field of Classification Search
USPC ..... 164/33, 34, 45
See application file for complete search history.

(56) References Cited

FOREIGN PATENT DOCUMENTS

| | | | |
|---|---|---|---|
| JP | 2003-205343 | A | 7/2003 |
| JP | 2003-290873 | A | 10/2003 |
| JP | 2011-110577 | A | 6/2011 |

OTHER PUBLICATIONS

Notification of Transmittal of Translation of the International Preliminary Report on Patentability and English translation of the Written Opinion of the International Searching Authority; PCT/JP2015/072202 dated Mar. 2, 2017; 7pp.

* cited by examiner

CASTING METHOD USING LOST FOAM

TECHNICAL FIELD

The present invention relates to a casting method using a lost foam for making a casting having a small hole.

BACKGROUND ART

Casting processes, such as, for example, investment casting (also known as lost wax process), plaster mold casting, and lost foam casting, have been developed as a method for making a casting with better dimensional accuracy than typical sand mold casting.

Among others, the lost foam casting is most suitable for forming a hole (referred to as a "cast hole") in a casting by casting. In the procedure of the lost foam casting, firstly, a casting pattern is obtained by applying a mold wash on the surface of a foam pattern. After the casting pattern is embedded in foundry sand, molten metal is then poured into the casting pattern, so that the foam pattern is lost (vaporized) and replaced with the molten metal. Finally, a casting is obtained by casting (solidifying) the molten metal.

Prior art documents disclosing the lost foam casting described above includes, for example, Patent Literature 1. Lost foam casting disclosed in Patent Literature 1 sets a casting time for casting based on the modulus of a pattern (i.e., volume of pattern÷surface area of pattern). This lost foam casting allows for the setting of accurate and precise casting time.

FIG. 15 is a schematic cross-sectional view of a cast hole formed by lost foam casting. When forming a cast hole using the lost foam casting, a mold wash 24 is applied to the surface of a foam pattern 22 having a hole 23 and thus a casting pattern 21 is made, as illustrated in FIG. 15. The hole 23 corresponds to where a small hole is formed by casting. By embedding the casting pattern 21 in foundry sand 25, the foundry sand 25 is placed around the casting pattern 21 and in the hole 23. Molten metal is then poured into the casting pattern 21 and the foam pattern 22 is replaced with the molten metal. Finally, a casting is obtained by casting (solidifying) the molten metal.

CITATION LIST

Patent Literature

Patent Literature 1; JP 2011-110577 A

SUMMARY OF INVENTION

During casting (solidification process), thermal loads from surrounding molten metal act on the mold wash 24 and various external forces applied to the surface of the hole 23 and on the foundry sand 25 packed in the hole 23. This results in the mold wash 24 in a hole end 23*a* or a central portion 23*b* of the hole 23 being damaged as illustrated in FIG. 15, and the molten metal seeps into the foundry sand 25 in the hole 23 and seizure may occur. Seizure refers to the fusion of molten metal and foundry sand 25. In particular, when a small hole with a diameter of 18 mm or less is formed as the hole 23 by casting, the mold wash 24 may be more susceptible to damage. If seizure occurs, the finish of the small hole is degraded.

In order to avoid the seizure, a small hole with a diameter of 18 mm or less and a length of 50 mm or more is formed by machining after forming a casting, rather than being formed by casting. Alternatively, material of the mold wash and casting conditions (temperature of the molten metal during pouring) are first determined by producing several trial samples using the lost foam casting, and then a casting having a small hole with a diameter of 18 mm or less and a length of 50 mm or more is made. However, with this latter production method, it is difficult to produce castings in a stable manner.

When a hole is positioned in a foam pattern at an angle θ with respect to a horizontal direction, a mold wash applied to the surface of the hole is subjected to bending stress. In this case, it is more difficult to form a small highly-finished hole.

An object of the present invention is to provide a casting method using the lost foam capable of forming a small highly-finished hole with a diameter of 18 mm or less and a length of 50 mm or more by casting.

The present invention includes the steps of embedding, in foundry sand, a casting pattern formed by applying a mold wash with a thickness of 1 mm or more to a surface of the foam pattern, the foam pattern having a hole with a diameter of D (mm); replacing the foam pattern with molten metal by pouring the molten metal into the casting pattern and losing the foam pattern; and forming a casting having a small hole with a diameter of 18 mm or less and a length of 50 mm or more by cooling the molten metal, and the invention satisfies the following formulas (0) and (1), $$2<D\leq 19.7 \qquad \text{Formula (0)}$$

$$\sigma c\geq -0.36+140/D^2 \qquad \text{Formula (1)}$$

where σc (MPa) is transverse rupture strength of the mold wash that is heated to decompose resin constituting the mold wash and then returned to room temperature.

DESCRIPTION OF EMBODIMENTS

Preferred embodiments of the present invention will now be described with reference to the drawings.

(Casting Method Using Lost Foam)

A casting method using a lost foam of the present embodiment includes the steps of embedding, in foundry sand (dry sand), a casting pattern formed by applying a mold wash with a thickness of 1 mm or more to a surface of a foam pattern, the foam pattern having a hole with a diameter of D (mm); replacing the foam pattern with molten metal by pouring the molten metal into the casting pattern and losing the foam pattern; and forming a casting having a small hole with a diameter of 18 mm or less and a length of 50 mm or more by cooling the molten metal.

Figure 1A:
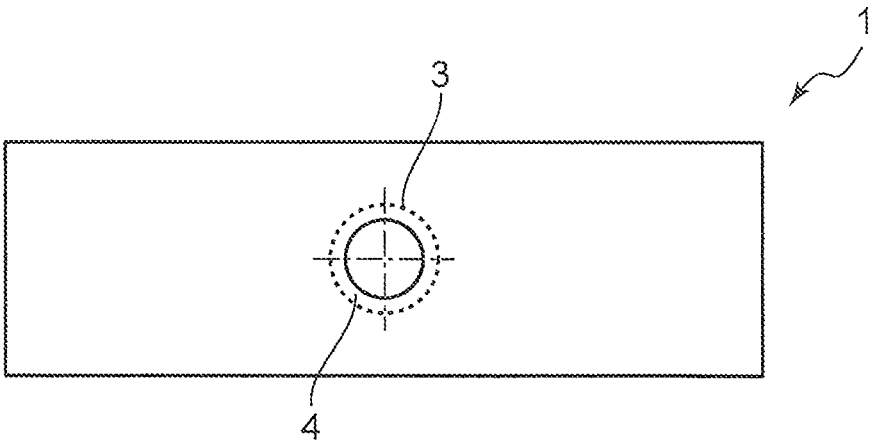
FIG. 1A is a top view of a casting pattern used in a casting method using the lost foam according to an embodiment.
Figure 1B:
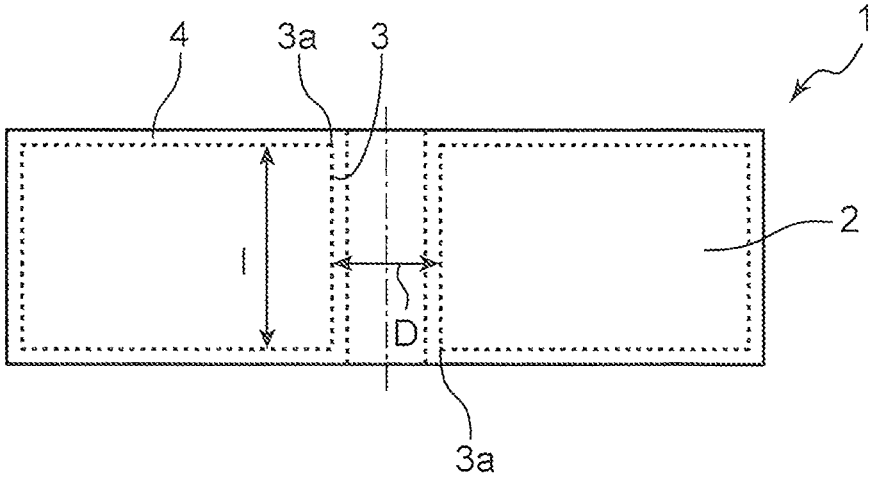
FIG. 1B is a side view of the casting pattern used in the casting method using the lost foam according to the embodiment.

FIG. 1A and FIG. 1B are a top view and a side view, respectively, of a casting pattern used in the casting method using the lost foam of the present embodiment. This casting method using the lost foam can make a casting having a small hole with a diameter of 18 mm or less and a length of 50 mm or more by using a casting pattern 1 illustrated in FIGS. 1A and 1B.

The casting method using the lost foam of the present embodiment includes, in addition to the above steps, melting metal (cast iron) to produce molten metal; molding a foam pattern; applying a mold wash on the surface of the foam pattern to obtain a casting pattern; and separating foundry sand from the casting.

The metal used for molten metal may be gray cast iron (JIS-FC250), flake graphite cast iron (JIS-FC300), or the like ("JIS" refers to the Japanese Industrial Standards). The foam pattern may be a foamed resin, such as polystyrene foam. The mold wash may be one constituting silica-based aggregate, or the like. The foundry sand may be $SiO_2$-based silica sand, zircon sand, chromite sand, synthetic ceramic sand, or the like. A binder or a curing agent may be added to the foundry sand.

As illustrated in FIGS. 1A and 1B, the casting pattern 1 includes a foam pattern 2 having a rectangular parallelepiped shape and a mold wash 4 applied to the surface of the foam pattern 2. The foam pattern 2 has a hole 3 extending from the center of its upper surface to the center of its lower surface. The hole 3 corresponds to where a small hole with a diameter of 18 mm or less and a length of 50 mm or more is formed in the casting by casting. As illustrated in FIG. 1A, the hole 3 has a substantially circular shape with a diameter of D (mm) in the top view of the casting pattern 1 and has a length of l (mm). As illustrated in FIG. 1B, the diameter D of the hole 3 is a length of a diameter connecting the surfaces of the foam pattern 2 rather than a length of a diameter connecting the surfaces of the mold wash 4 applied to the surface of the hole 3. The vicinities of the upper and lower ends of the hole 3 are not machined (i.e., are not chamfered), such as by being tapered, and the surface of the hole 3 forms sharply-defined edges with the upper and lower surfaces of the foam pattern 2.

The diameter of the small hole formed of the hole 3 is preferably 10 mm or more and 18 mm or less. The application of 3 mm thick mold wash 4 to the hole 3 with a diameter D less than 10 mm reduces the diameter of an inner space of the hole 3 to less than 4 mm, so that it is difficult to load foundry sand in the inner space of the hole 3. The length l of the hole 3 is more preferably 50 mm or more. Assuming that the length l of the hole 3 is less than 50 mm, the ratio of the length l of the hole 3 to the diameter D (i.e., l/D) is 3 or less when the diameter of the hole 3 is 18 mm, so that a small hole can be formed by conventional casting method without using the casting method using the lost foam of the present embodiment. The thickness of the mold wash 4 is preferably 1 mm or more and 3 mm or less. This is because if the thickness of the mold wash 4 exceeds 3 mm, it is necessary to repeat the application and drying of the mold wash three times or more, which takes time and labor and is likely to cause uneven thickness. The diameter D of the hole 3 and the thickness of the mold wash 4 satisfy the following formulas (0) and (1).

$$2<D\leq 19.7 \qquad \text{Formula (0)}$$

$$\sigma c\geq -0.36+140/D^2 \qquad \text{Formula (1)}$$

Wherein, if the diameter D of the hole is less than 2 mm in the formula (0), a mold wash with a thickness of 1 mm or more cannot be applied. Meanwhile, if the diameter D of the hole exceeds 19.7, it is difficult to form a small hole with a diameter of 18 mm or less. In the formula (1), σc is the transverse rupture strength (bending strength) (MPa) of the mold wash that is heated to decompose resin constituting the mold wash and then returned to room temperature. The formula (1) is a mathematical formula obtained based on experimental results where the thickness of the mold wash is 1 mm and the length l of the hole is 100 mm, and the formula (1) can be applied to a case where a small hole with a length of 100 mm or less is formed in the casting.

Herein, the transverse rupture strength of the mold wash refers to a bending strength, which may be referred to as transverse rupture stress. The transverse rupture strength of the mold wash is a value of the bending stress calculated based on the maximum load prior to fracture of a specimen in a bending test, and measurements determined by the following method are used. First, a mold wash is poured into a mold and is allowed to dry for 12 hours or more at room temperature or at 25° C. Next, the mold wash is dried for 2 hours or more using a constant temperature dryer at 50° C., and then a measurement specimen with a size of 50 mm×10 mm and a thickness of 2±0.5 mm is cut. A load of 0.05 N/s to 0.1 N/s is applied to the surface of the measurement specimen that was in contact with the mold using a bending test machine, and transverse rupture stress is measured under the center point load by three-point bending test, using a test jig with a support span of 40 mm and a fulcrum end shape of R1.5 mm. After testing, the thickness of a fracture surface of the specimen is measured at three or more points including the center and both ends, and the transverse rupture strength (MPa) of the mold wash is calculated from the average of the measurements. Two measurement specimens are made in a manner similar to that described above and the three-point bending test is performed three times in a similar manner. The average of the transverse rupture strengths thus obtained is defined as transverse rupture strength of the mold wash.

The above description "heated to decompose resin" means that resin constituting the mold wash is heated to a temperature equal to or higher than a glass transition temperature (Tg) of the resin. By satisfying the formula (1) and setting the thickness of the mold wash to 1 mm or more, a casting having a small hole with a diameter of 18 mm or less and a length of 50 mm or more can be made without damaging the mold wash.

An angle θ of the axis of the hole 3 with respect to a horizontal direction is preferably determined based on the density of molten metal, a vertical height difference between the hole and a sprue for the molten metal, and the material and thickness of the mold wash. Specifically, the hole is positioned such that the following formula (2) is satisfied, where the length of the hole 3 is l (mm), the density of molten metal is $\rho_m$ (kg/mm$^3$), the average density of the hole is $\rho_d$ (kg/mm$^3$), and the gravitational acceleration is g.

$$\cos^2\theta \leq 0.04/\{(\rho_m-\rho_d)g\}\times D/l^2 \quad \text{Formula (2)}$$

The average density $\rho_d$ of the hole is a value that is calculated by weighted-averaging the density ρ of foundry sand packed in the hole and the density $\rho_c$ of a mold wash applied to the surface of the hole and dried, according to the respective thicknesses. The sprue for the molten metal means a location where the molten metal is poured, and in particular, where the foundry sand around the foam pattern is open above the hole.

When a casting having a small hole extending vertically is made, the mold wash 4 is subjected to the following external forces:

(1) Hydrostatic pressure (σp) of molten metal (2) Dynamic pressure (σm) due to flow of molten metal (3) Thermal contraction/expansion difference (σthout) between mold wash and molten metal during solidification (4) Thermal contraction/expansion difference (σthin) between foundry sand and mold wash in hole 3

(5) Pressure (Pgout) (σgout) of gas produced by combustion of foam pattern (6) Internal pressure (Pgin) (σgin) generated by gas produced by combustion of foam pattern and accumulated in hole 3

Therefore, when the following formula (3) is satisfied where sub is the strength of the mold wash at a high temperature equivalent to the temperature of the molten metal (liquid metal), it is possible to form a cast hole without damaging the mold wash.

$$\sigma b > \sigma p + \sigma m + \sigma th\text{out} + \sigma th\text{in} + \sigma\text{gout} + \sigma\text{gin} \quad \text{Formula (3)}$$

The external forces (1) to (6) will be discussed below.

(Hydrostatic Pressure σp of Molten Metal)

Figure 2:
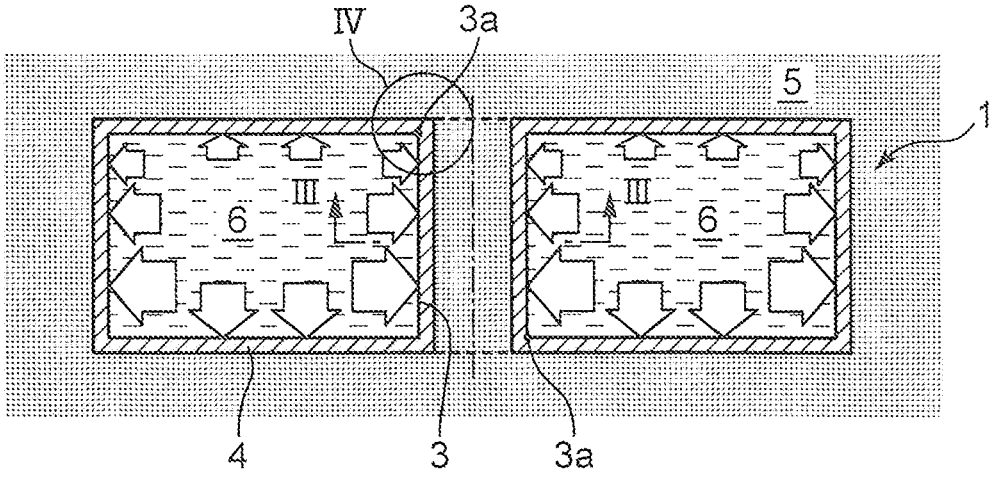
FIG. 2 is a cross-sectional view of a casting pattern after the foam pattern has been replaced with molten metal.
Figure 3:
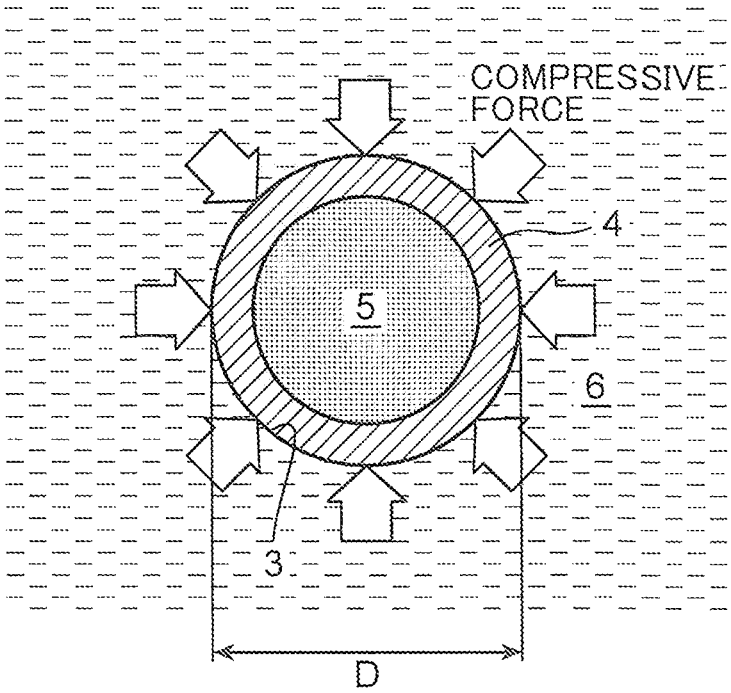
FIG. 3 is a cross-sectional view taken along line III-III in FIG. 2.
Figure 4:
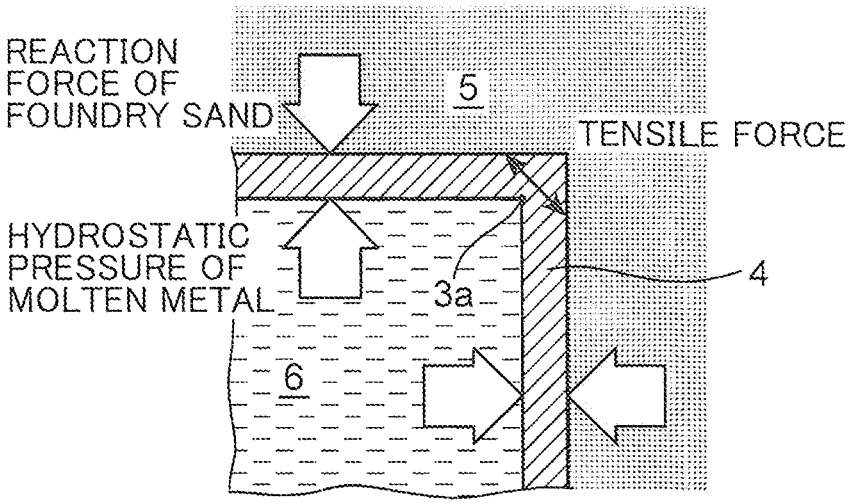
FIG. 4 is an enlarged view of a main part IV in FIG. 2.

FIG. 2 is a cross-sectional view of the casting pattern 1 after the foam pattern 2 has been replaced with molten metal 6, FIG. 3 is a cross-sectional view taken along line III-III in FIG. 2, and FIG. 4 is an enlarged view of a main part IV in FIG. 2. When the foam pattern 2 is replaced with the molten metal 6, foundry sand 5 packed around the mold wash 4 is subjected to the hydrostatic pressure of the molten metal 6 as illustrated in FIG. 2. The mold wash 4 applied to the surface of the hole 3 is subjected to circumferential compressive force as illustrated in FIG. 3.

When the amount of the foundry sand 5 packed in the hole 3 is sufficient, the hydrostatic pressure of the molten metal 6 acting on the mold wash 4 applied to a hole edge 3*a* and reaction force from the foundry sand 5 are balanced as illustrated in FIG. 4. Accordingly, the axial load of the hole 3 is negligible.

On the other hand, if the amount of the foundry sand 5 packed in the hole 3 is insufficient, the mold wash 4 applied to the hole edge 3*a* is subjected to bending stress due to the hydrostatic pressure of the molten metal 6 (i.e., buoyancy) without being subjected to the reaction force from the foundry sand 5.

External force w (N/mm) on the hole 3 (semicircle) due to the hydrostatic pressure of the molten metal 6 is expressed by the following formula (4), where the diameter of the hole 3 is D (mm), the gravitational acceleration is g, the density of the molten metal 6 is $\rho_m$ (kg/mm$^3$), and an average head difference (i.e., vertical height difference between the sprue for the molten metal and the hole 3) is h (mm).

$$\begin{aligned} w &= \rho_m g h \times \int (D/2\sin\theta \times \theta)d\theta \\ &= \rho_m g h D/2 \times \int \sin^2\theta d\theta \\ &= \rho_m g h D/2[\theta/2 - \sin 2\theta/4] \\ &= (\pi/4)\rho_m g h D \end{aligned} \quad \text{Formula (4)}$$

Assuming that there is no reaction force from the foundry sand 5 packed in the hole 3 and approximating it by a flat plate, stress $\rho_c$ (MPa) acting on the mold wash 4 with a thickness of t (mm) applied to the surface of the hole 3 is expressed by the following formula (5) based on the beam theory.

$$\sigma_c \approx M/I \times t/2 = (\pi/8)\rho_m g h l^2/t^2 \quad \text{Formula (5)}$$

In the formula (5), M is a bending moment acting on both ends of the hole 3 and I is the second moment of area of a semicylinder, M and I being expressed by the following formulas.

$$M = (\pi/48)\rho_m g h D l^2$$

$$I = Dt^3/12$$

Figure 5:
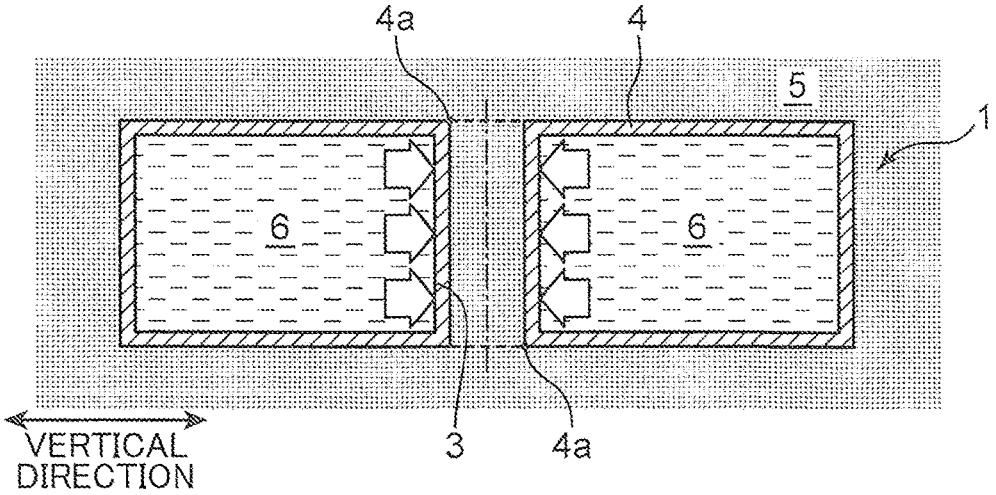
FIG. 5 is a cross-sectional view of the casting pattern, showing a direction of bending stress due to hydrostatic pressure of the molten metal.
Figure 6:
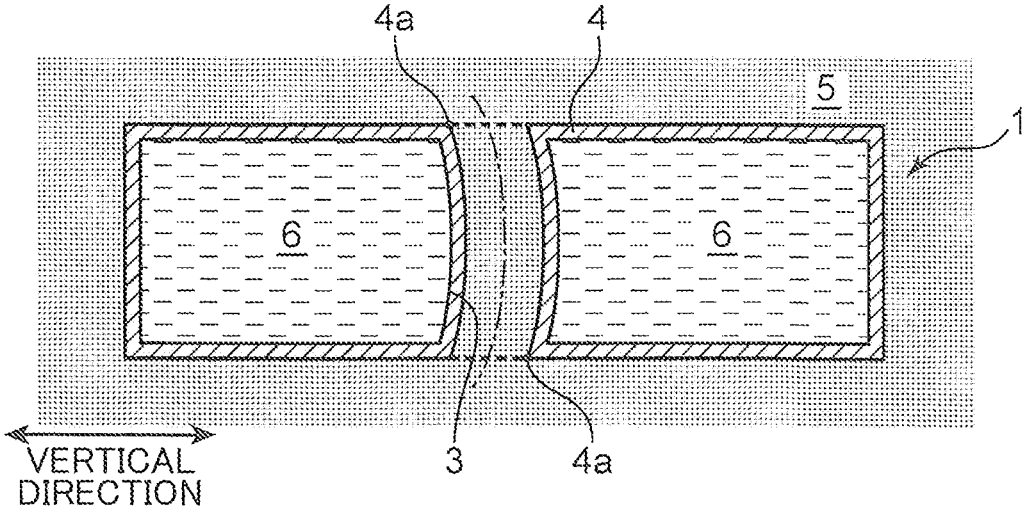
FIG. 6 is a cross-sectional view of the casting pattern, where its hole has been deformed by bending stresses acting on ends of a mold wash.

FIG. 5 is a cross-sectional view of the casting pattern, showing the direction of bending stress due to the hydrostatic pressure of the molten metal. FIG. 6 is a cross-sectional view of the casting pattern, where its hole has been deformed by bending stresses acting on ends 4*a* of the mold wash 4. FIGS. 5 and 6 illustrates a case where an angle θ of the axis of the hole 3 with respect to the horizontal direction is zero degrees, and the left side of FIGS. 5 and 6 is the bottom side of the casting pattern and the right side thereof is the top side of the casting pattern. When the amount of the foundry sand 5 packed in the hole 3 is sufficient, cylindrical mold wash 4 applied to the surface of the hole 3 is subjected to bending stress due to the hydrostatic pressure of the molten metal 6 (i.e., buoyancy), as illustrated in FIG. 5. That is, the stress acting on the mold wash 4 with a thickness of t applied to the surface of the hole 3, the axis of which is positioned at an angle θ with respect to the horizontal direction, is the greatest at the end 4*a* of the mold wash 4 based on the beam theory, and stress $\sigma_d$ (MPa) acting on the end 4*a* is expressed by the following formula (6). This bending stress $\sigma_d$ causes the hole 3 to deform as illustrated in FIG. 6.

$$\sigma_d = M/I \times D/2 \qquad \text{Formula (6)}$$

$$= 2/3(l\cos\theta)^2 \times (\rho_m - \rho_d)g/D$$

In the formula (6), M is the bending moment acting on both ends of the hole 3 and I is the second moment of area of a semicylinder.

$$M=(\pi D^2/4)\times(\rho_m-\rho_d)\times g\times l^2/12$$

$$I=\pi/64\times D^4$$

As described above, hydrostatic pressure σp of the molten metal is the resultant force of stress $\sigma_c$ acting on the mold wash 4 and stress $\sigma_d$ acting on the end 4*a* of the mold wash 4, the hydrostatic pressure σp being expressed by the following formula (6-2).

$$\sigma p=\sigma_c+\sigma_d \qquad \text{Formula (6-2)}$$

(Dynamic Pressure Due to Flow of Molten Metal)

Dynamic pressure due to flow of molten metal is negligible because the molten metal flows gently.

(Thermal Contraction/Expansion Difference Between Mold Wash and Molten Metal During Solidification)

A coefficient of linear expansion is greater for cast iron than for foundry sand. Therefore, thermal contraction/expansion difference between the mold wash and the molten metal during solidification exerts compressive force in the axial direction of the mold wash. This compressive force can cause the mold wash applied to the surface of the hole 3 to be damaged by buckling, but the compressive force is considered to be negligibly small. Circumferential stress of the mold wash is also negligible.

(Thermal Contraction/Expansion Difference Between Foundry Sand and Mold Wash in Hole)

The foundry sand and the mold wash 4 in the hole 3 undergo a smaller temperature change than the molten metal. Therefore, the effect of thermal contraction/expansion difference between the foundry sand and the mold wash in the hole 3 is negligible because it is less than the effect of the thermal contraction/expansion difference between the mold wash and the molten metal during solidification.

(Pressure of Gas Produced by Combustion of Foam Pattern)

Figure 7:
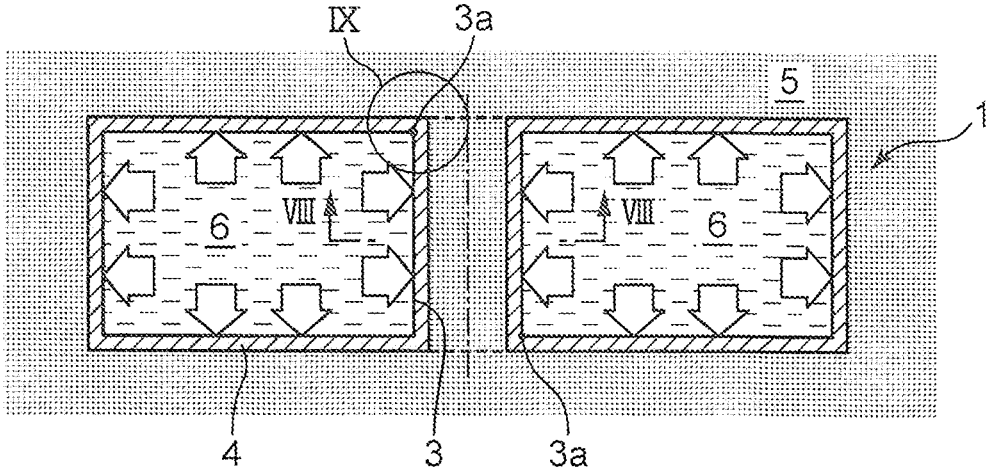
FIG. 7 is a cross-sectional view of the casting pattern, showing a direction of gas pressure generated by combustion of the foam pattern.

FIG. 7 is a cross-sectional view of the casting pattern 1, showing the direction of gas pressure generated by combustion of the foam pattern 2. When the foam pattern 2 is lost and replaced with the molten metal 6 as illustrated in FIG. 7, the foundry sand 5 packed around the foam pattern 2 is subjected to the pressure of the gas produced by combustion of the foam pattern 2.

Figure 8:
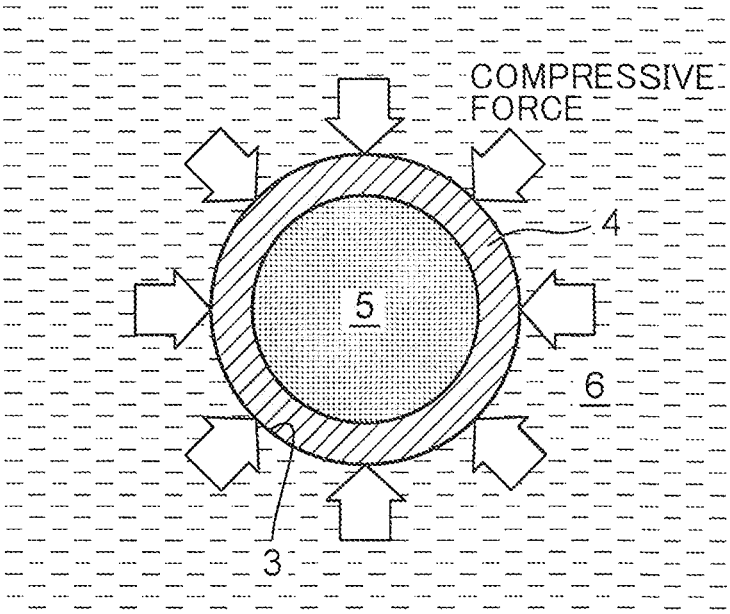
FIG. 8 is a cross-sectional view taken along line VIII-VIII in FIG. 7.
Figure 9:
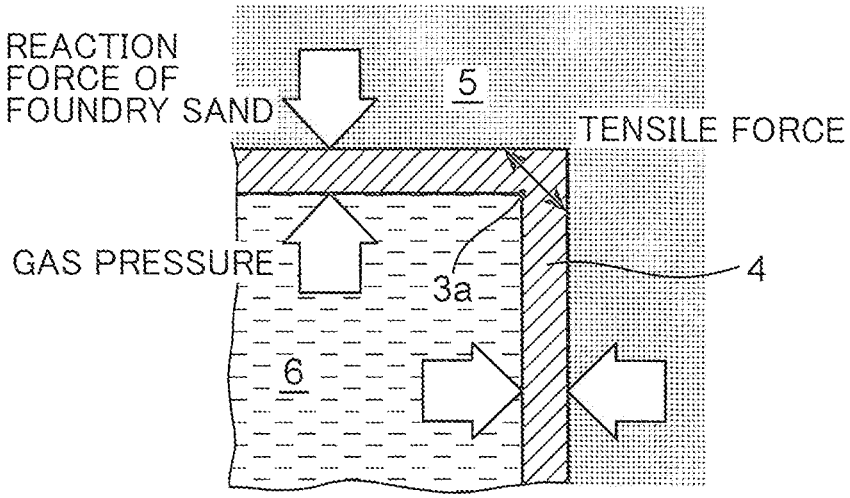
FIG. 9 is an enlarged view of a main part IX in FIG. 7.

FIG. 8 is a cross-sectional view taken along line VIII-VIII in FIG. 7, and FIG. 9 is an enlarged view of a main part IX in FIG. 7. As illustrated in FIG. 8, the mold wash 4 applied to the surface of the hole 3 is subjected to circumferential compressive force due to the pressure of the gas produced by combustion of the foam pattern 2. The mold wash 4 applied to the surface of the hole 3 exerts tensile force given by the following formula (7) in the axial direction of the hole 3, as illustrated in FIG. 9.

$$\sigma gout \propto Pgout/D^2 \qquad \text{Formula (7)}$$

As illustrated in FIG. 9, when the amount of the foundry sand 5 packed around the foam pattern 2 is sufficient, the pressure of the gas and the reaction force from the foundry sand 5 are balanced so that the axial load of the hole 3 is negligible.

(Internal Pressure Generated by Gas Produced by Combustion of Foam Pattern and Accumulated in Hole)

Internal pressure generated by the gas produced by combustion of the foam pattern 2 and accumulated in the hole 3 causes, in the mold wash 4, circumferential stress given by the formula (8) and axial stress given by the formula (9).

$$\sigma gin \approx D\times Pgin/t \qquad \text{Formula (8)}$$

$$\sigma ginz \approx D\times Pgin/(2t) \qquad \text{Formula (9)}$$

Since the smaller the diameter D of the hole 3 is, the more difficult it is to form the hole by casting, it can be said that the effects of the external forces expressed by the formulas (8) and (9) are negligibly small.

Thus, the load on the mold wash is small when the amount of the packed foundry sand is sufficient. However, in practice, the reaction force from the foundry sand is not sufficient, and the mold wash is subjected to the bending stress due to the hydrostatic pressure of the molten metal and axial tensile force due to the pressure of the gas produced by combustion of the foam pattern 2. Accordingly, the mold wash needs to have a strength to withstand these bending stress and tensile force. As such, the formula (3) can be approximated as a casting condition by the formula (10), using the formulas (5), (6), (6-2), and (7).

$$\sigma b>\sigma p+\sigma gout=(\pi/8)\rho_m ghl^2/t^2+2/3(l\cos\theta)^2\times(\rho_m-\rho_d)g/D+kPgout/D^2+\gamma \qquad \text{Formula (10)}$$

Wherein, k is a proportional constant, and $\gamma=\sigma m+\sigma thout+\sigma thin+\sigma gin\approx 0$.

The formula (10) is a condition under which it is assumed that there is no reaction force of the foundry sand. Accordingly, when replacing terms with respective coefficients while taking into account the reaction force of the foundry sand, a function of the diameter D of the hole 3, the length l of the hole 3, and the thickness t of the mold wash can be expressed by the following formula (11).

$$\sigma b>\alpha\cdot l^2/t^2+\beta/D^2+\omega D^3/\{D^4-(D-2t)^4\} \qquad \text{Formula (11)}$$

Wherein, transverse rupture strength σc (MPa) of the mold wash that is heated to decompose resin and then returned to room temperature is used instead of strength sub (MPa) of the mold wash at high temperature. That is, the formula (11) is expressed by the following formula (12) based on the relationship between the transverse rupture strength of the mold wash that is heated to decompose resin and then returned to room temperature and a diameter capable of casting a hole (i.e., a castable diameter). The relationship between the transverse rupture strength of the mold wash that is heated to resin decomposition and then returned to room temperature and the castable diameter is described below.

$$\sigma c \geq -0.36+140/D^2 \qquad \text{Formula (12)}$$

By applying a mold wash satisfying the formula (12) to the foam pattern with a thickness of 1 mm or more, a casting having a small hole with a diameter of 18 mm or less and a length of 50 mm or more can be made without damaging the mold wash.

Additionally, the formula (13) is calculated based on a stress increase allowable as the casting condition in the formula (10).

$$\cos^2\theta \leq 0.04/\{(\rho_m-\rho_d)g\}\times D/l^2 \qquad \text{Formula (13)}$$

Therefore, when θ is the angle of the axis of the hole with respect to the horizontal direction, by positioning the hole so as to satisfy the formula (13), a casting having a small hole with a diameter of 18 mm or less and a length of 50 mm or more can be made without damaging the mold wash.

(Casting Evaluation)

Next, the diameter of the hole 3 capable of being formed by casting was evaluated, where thickness of the mold wash was 1 mm, a length l of a small hole formed by casting was 100 mm, an angle of the axis of the hole 3 with respect to the horizontal direction was zero (θ=0), and several types of mold wash and several types of foundry sands were used as shown in Table 1 and Table 2, respectively. The results are shown in Table 3.

TABLE 1

| Mold Wash | Bulk Density $\rho_c$ (g/cm$^3$) | Transverse Rupture Strength at Room Temperature TSc' (MPa) | Aggregate Particle Diameter (×100 μm) |
|---|---|---|---|
| A | 1.3 to 1.5 | >1.5 | 1 |
| B | 2.8 to 3.0 | >4.4 | 0.9 |
| C | 1.3 to 1.5 | >5.0 | 1.5 |

All values of the properties are those after drying

TABLE 2

| Common Product Name | Base | Bulk Density $\rho_c$ (g/cm$^3$) | Linear Expansion Coefficient as (1/° C.) |
|---|---|---|---|
| Silica Sand | $SiO_2$ | 1.3 to 1.5 | $1 \times 10^{-5}$ |
| Artificial Sand | $Al_2O_3$ | 1.7 | $0.3 \times 10^{-5}$ |
| | $3Al_2O_3 \bullet 2SiO^2$ | | |
| Zircon Sand | $ZrO_2 \bullet SiO_2$ | 2.8 to 3.0 | $0.3 \times 10^{-5}$ |

TABLE 3

| Combination | Mold Wash | Sand in Hole | Castable Diameter (Average Value *) (mm) |
|---|---|---|---|
| 1 | A | Silica Sand | 16 |
| 2 | A | Zircon Sand | 14 |
| 3 | A | Artificial Sand | 11 |
| 4 | B | Silica Sand | 13 |
| 5 | B | Zircon Sand | 11 |
| 6 | B | Artificial Sand | 12 |
| 7 | C | Silica Sand | 17 |
| 8 | C | Zircon Sand | 16 |
| 9 | C | Artificial Sand | 16 |

* Average of value when using resin and value when using no resin

The evaluation has been carried out by the same casting method, using gray cast iron (JIS-FC250) of the same composition. Therefore, it can be estimated that all three types of mold washes in Table 1 satisfy the formula (11) for strength at high temperature (maximum temperature of about 1200° C.).

Figure 10:
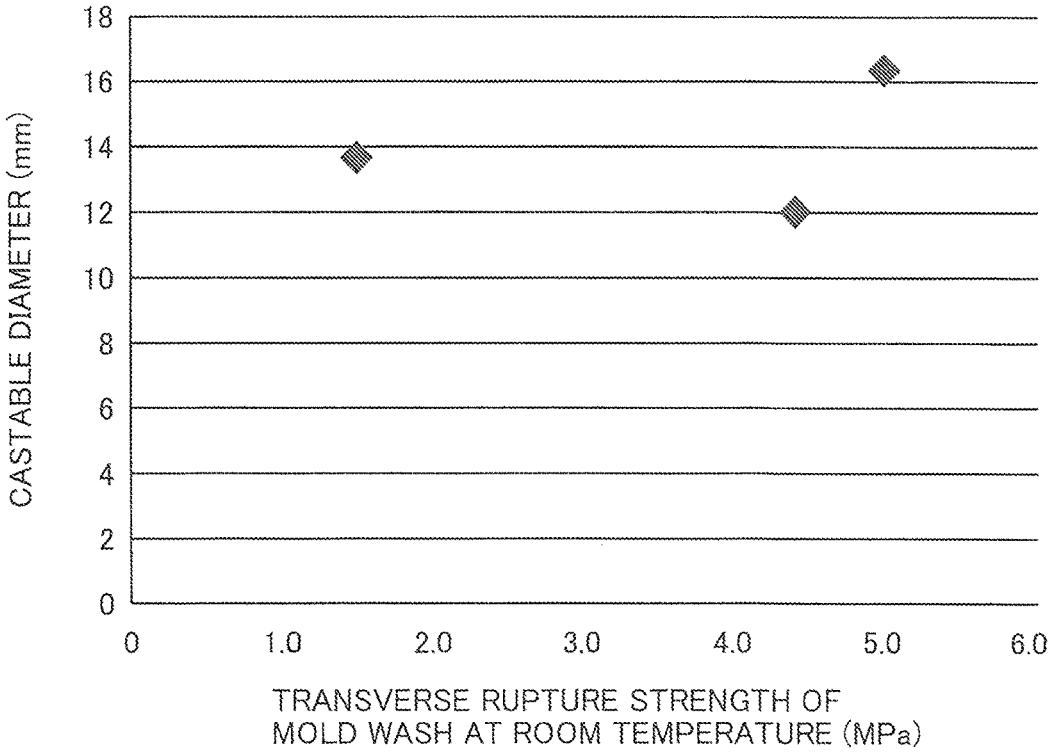
FIG. 10 is a graph showing the relationship between transverse rupture strength of a dried mold wash at room temperature and a castable diameter.

Here, since it is difficult to directly measure the strength of the mold wash at high temperature, a method of indirectly estimating the strength of mold wash at high temperature was studied. FIG. 10 is a graph showing the relationship between transverse rupture strength (bending strength) (Table 1) of a dried mold wash at room temperature and a castable diameter (Table 3). As can be seen in FIG. 10, the correlation between the transverse rupture strength of the mold wash at room temperature and the high temperature strength of the mold wash is small. This is because the transverse rupture strength after the mold wash has dried is strongly affected by the properties of binder (resin component), while strength characteristics due to another mechanism related to carbon (or carbide) produced by decomposition of the binder become dominant when the mold wash is heated to 200° C. to 400° C. or more during casting.

Figure 11:
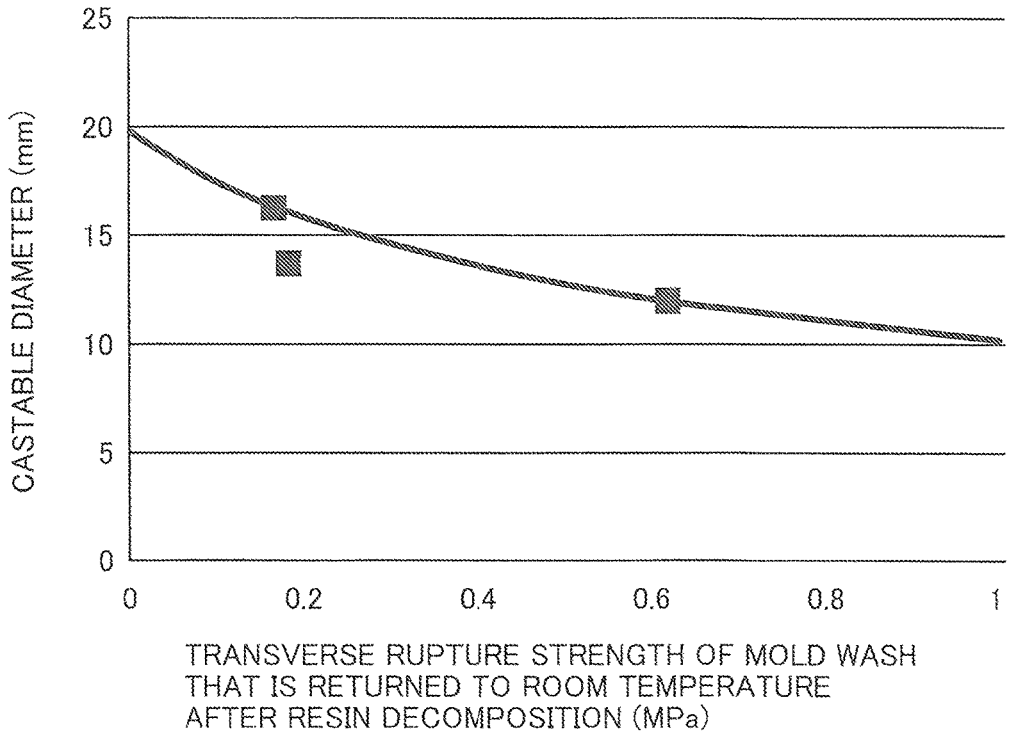
FIG. 11 is a graph showing the relationship between transverse rupture strength of the mold wash that is heated to resin decomposition and then returned to room temperature and a castable diameter.

Accordingly, a dried mold wash was heated to resin decomposition to obtain a sintered body. After cooling the sintered body to room temperature, transverse rupture strength was measured. In the present embodiment, a transverse rupture strength test was carried out by heating a dried mold wash to 1100° C. and then cooling to room temperature. FIG. 11 shows the relationship between transverse rupture strength of the mold wash that is heated to resin decomposition and then returned to room temperature and the castable diameter.

The relationship shown in FIG. 11 leads to the following formula (14), where the diameter of a hole formed by casting is D (mm) and the transverse rupture strength (bending strength) of the mold wash that is once heated to resin decomposition and then returned to room temperature is σc (MPa).

$$\sigma c \geq -0.36 + 140/D^2 \qquad \text{Formula (14)}$$

Accordingly, it is shown that a casting having a small hole with a diameter of 18 mm or less and a length of 50 mm or more can be made without damaging the mold wash by using a mold wash satisfying the formula (14).

Figure 12:
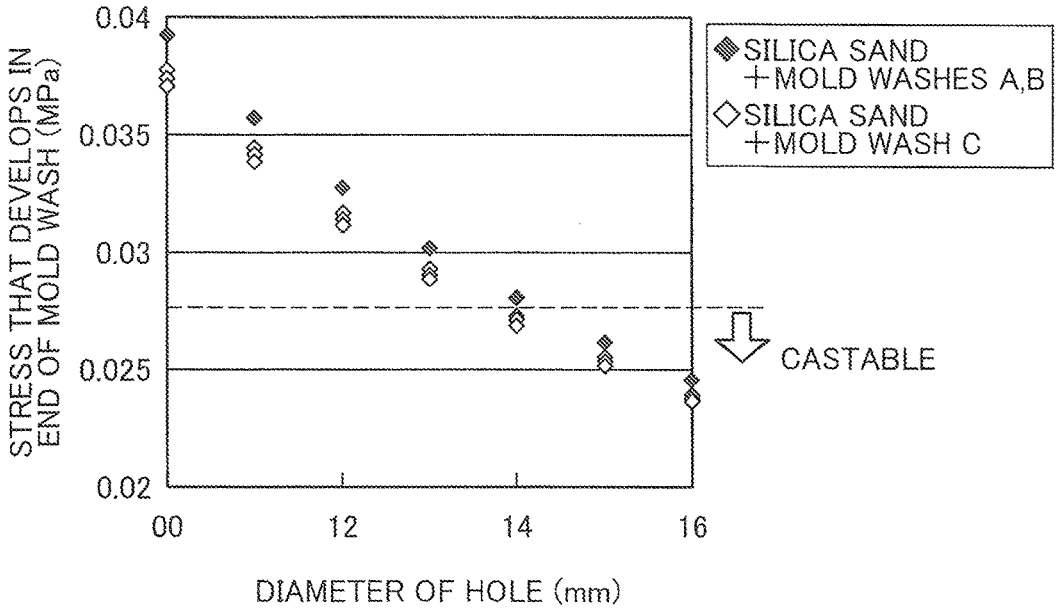
FIG. 12 is a graph showing the relationship between the diameter of the hole and stress that develops in the end of the mold wash due to buoyancy (i.e., hydrostatic pressure of the molten metal).

Additionally, a similar experiment was carried out, where the diameter D of the hole 3 was varied in 1 mm increments between 10 mm and 16 mm and the angle of the axis of the hole 3 with respect to the horizontal direction is 45 degrees (θ=45°). Three types of mold washes, satisfying the formula (14), were used. FIG. 12 is a graph showing the relationship between the diameter D of the hole 3 and stress that develops in the end of the mold wash due to buoyancy (i.e., hydrostatic pressure of the molten metal).

From the graph in FIG. 12 and the results of casting availability, the stress increase which is allowable as the casting condition in the formula (10) is 0.0275 MPa or less. That is, when the formula (15) is satisfied, a hole can be formed by casting.

$$0.0275 \geq 2/3(l \cos\theta)^2 \times (\rho_m - \rho_d) g/D \qquad \text{Formula (15)}$$

Therefore, when the hole 3 with a diameter D and a length l is formed in the foam pattern 2, the hole 3 may be positioned such that the angle θ of the axis of the hole 3 with respect to the horizontal direction satisfies the following formula (16).

$$\cos^2\theta \leq 0.04/\{(\rho_m - \rho_d)g\} \times D/l^2 \qquad \text{Formula (16)}$$

EXAMPLE

Figure 13A:
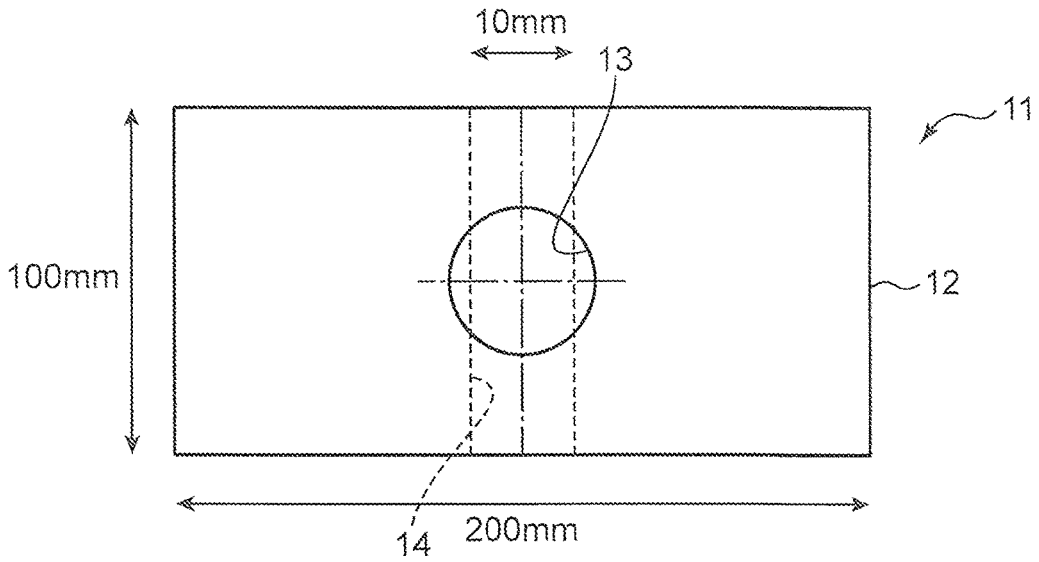
FIG. 13A is a top view of a casting pattern of Example 1.
Figure 13B:
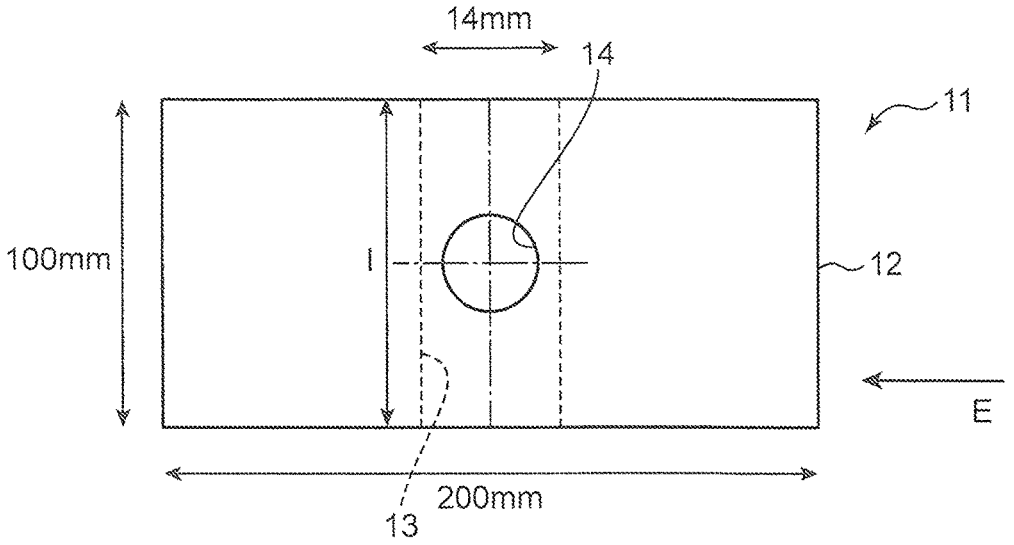
FIG. 13B is a side view of the casting pattern of Example 1.
Figure 13C:
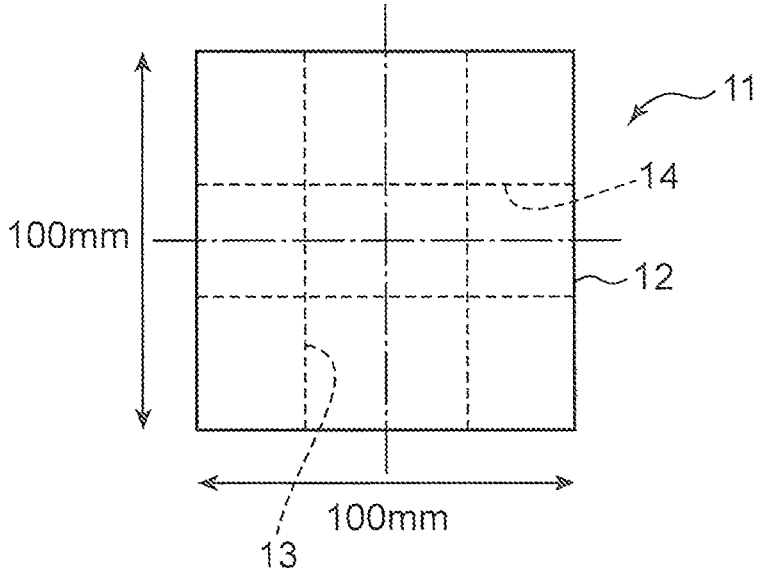
FIG. 13C is a side view of the casting pattern of FIG. 13B seen from a direction E.

FIG. 13A and FIG. 13B are a top and a side view, respectively, of a casting pattern of Example 1, and FIG. 13C is a side view of the casting pattern of FIG. 13B seen from a direction E. As illustrated in FIGS. 13A, 13B, and 13C, the casting pattern of Example 1 is a foam pattern 12 having a rectangular parallelepiped shape of 100 (mm)×100 (mm)×200 (mm), the foam pattern 12 being provided with a hole 13 with a diameter of 14 mm extending from the upper surface to the lower surface and a hole 14 with a diameter of 10 mm extending from one of a pair of opposite sides to the other. The lengths of the holes 13 and 14 are both 100 mm. A casting having two small holes was made using the casting pattern 11.

Gray cast iron (JIS-FC250) was used as molten metal. A mold wash (B in Table 1) that was obtained by substituting D=14 (mm) into the formula (1) and was formed of silica-based aggregate with an aggregate diameter of 100 μm or less was used for casting. $SiO_2$-based silica sand was used as foundry sand.

Relational expressions of the following formulas (17) and (18) were obtained by substituting gray cast density $\rho_m=7.3\times10^{-6}$ (kg/mm$^3$), foundry sand density $\rho=1.3\times10^{-6}$ (kg/mm$^3$), and mold wash density $\rho_c=1.3\times10^{-6}$ (kg/mm$^3$) into the formula (2) as well as by substituting D=10 (mm) and D=14 (mm) into the formula (2).

(When D=10)

$$l \cos\theta \leq 82 \text{ (mm)} \quad \text{Formula (17)}$$

(When D=14)

$$l \cos\theta \leq 98 \text{ (mm)} \quad \text{Formula (18)}$$

Figure 14:
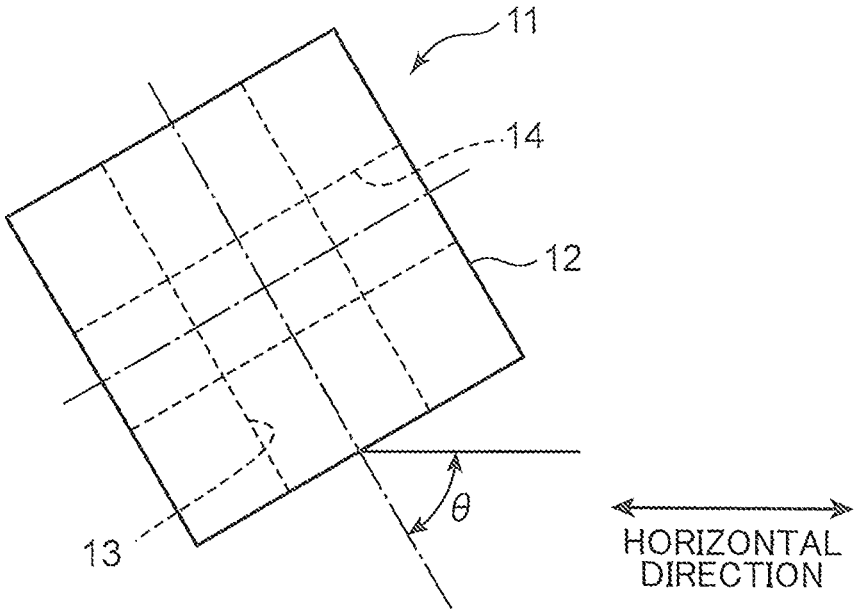
FIG. 14 is a side view of the casting pattern, where a hole of the casting pattern in Example 1 is positioned at an angle θ with respect to a horizontal direction.
Figure 15:
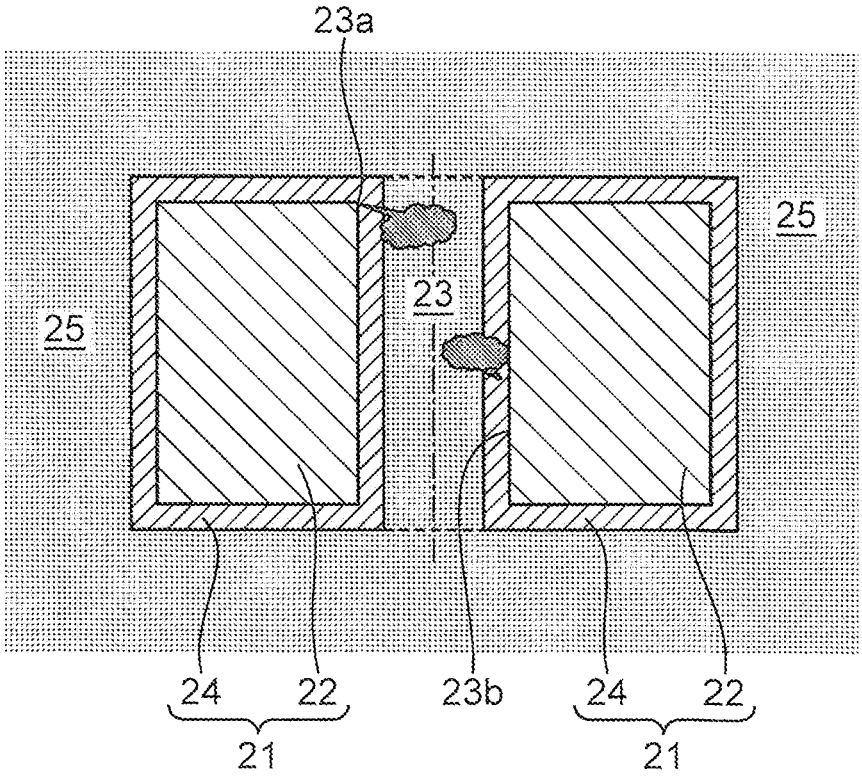
FIG. 15 is a schematic cross-sectional view of a cast hole formed by lost foam casting.

FIG. 14 is a side view of the casting pattern, where the hole of the casting pattern in Example 1 is positioned at an angle θ with respect to a horizontal direction. In order to satisfy the formulas (17) and (18), the hole needs to be inclined so that the angle θ of the axis of the hole with respect to the horizontal direction satisfies the following range, as illustrated in FIG. 14.

$$0.60 \leq \theta \leq 1.35 \text{ (radian)}$$

With the holes 13 and 14 positioned at such an angle, a small highly-finished hole could be formed without seizure by casting.

On the other hand, if the casting pattern 11 cannot be inclined in casting, the hole 14 with a diameter of 10 mm may be positioned vertically. Here, for a small hole with a diameter of 14 mm, the condition of the present embodiment can provide only a casting with a length less than or equal to 98 mm. Accordingly, zircon sand was packed in the hole 13, for example, and the average density $\rho_d$ of the hole 13 (i.e., a value obtained by averaging the density ρ of foundry sand packed in the hole 13 and the density ρc of the mold wash applied to the surface of the hole 13) was set to $1.8\times10^{-6}$ (kg/mm$^3$) or more, which allowed a small hole with a diameter of 14 mm and a length of 100 mm to be formed by casting. If the design permits, the substantial length of the hole 13 may be set to 98 mm or less by forming a counterbore of 2 mm around the hole 13. In this way, a small highly-finished hole could be formed by casting.

(Advantageous Effects)

As described above, according to the casting method using lost foam of the present embodiment, a mold wash is less likely to be damaged and thus seizure is less likely to occur during casting, so that a casting having a small highly-finished hole with a diameter of 18 mm or less and a length of 50 mm or more can be made.

Additionally, the axis of the hole 3 with a diameter of D (mm) and a length of l (mm) is positioned at the angle θ satisfying the formula (2) with respect to the horizontal direction. By positioning the hole 3 at the angle θ satisfying the formula (2), a casting having a small hole with a diameter of 18 mm or less and a length of 50 mm or more can be made without damaging the mold wash.

While the embodiment of the present invention has been described above, this description is merely illustrative of the exemplary embodiment and is not intended to limit the present invention. Such a particular configuration may be varied in design as needed. The effects disclosed in the embodiment of the invention merely exemplify the most preferable effects resulting from the invention, and the effects according to the present invention are not limited to those disclosed in the embodiment of the present invention.

The invention claimed is:

1. A casting method using lost foam comprising the steps of:

embedding, in foundry sand, a casting pattern formed by applying a mold wash with a thickness of 1 mm or more to a surface of the foam pattern, the foam pattern having a hole with a diameter of D (mm);

replacing the foam pattern with molten metal by pouring the molten metal into the casting pattern and losing the foam pattern; and forming a casting having a small hole with a diameter of 18 mm or less and a length of 50 mm or more by cooling the molten metal, wherein the method satisfies the following formulas (0) and (1), $$2 < D \leq 19.7 \quad \text{Formula (0)}$$

$$\sigma c \geq -0.36 + 140/D^2 \quad \text{Formula (1)}$$

where σc (MPa) is transverse rupture strength of the mold wash that is heated to decompose resin constituting the mold wash and then returned to room temperature, wherein the hole is positioned such that the following formula (2) is satisfied:

$$\cos^2\theta \leq 0.04/\{(\rho_m-\rho_d)g\}\times D/l^2 \quad \text{Formula (2)}$$

where a length of the hole is 1 (mm), an angle of an axis of the hole with respect to a horizontal direction is θ, density of the molten metal is $\rho_m$ (kg/mm$^3$), average density of the hole is $\rho_d$ (kg/mm$^3$), and gravitational acceleration is g.

* * * * *